US008376320B1

(12) United States Patent
Gill

(10) Patent No.: US 8,376,320 B1
(45) Date of Patent: Feb. 19, 2013

(54) SCISSOR LIFT ASSEMBLY WITH ELECTRIFIED RODS FOR FORMING A RETAINING OR BARRIER STRUCTURE

(76) Inventor: Earl F. Gill, Pittsboro, NC (US)

( * ) Notice: Subject to any disclaimer, the term of this patent is extended or adjusted under 35 U.S.C. 154(b) by 0 days.

(21) Appl. No.: 13/400,836

(22) Filed: Feb. 21, 2012

Related U.S. Application Data

(63) Continuation-in-part of application No. 12/180,918, filed on Jul. 28, 2008, now abandoned.

(51) Int. Cl.
*A01K 3/00* (2006.01)

(52) U.S. Cl. ..... 256/10; 256/1; 256/32; 256/DIG. 2

(58) Field of Classification Search ..... 256/1, 10, 256/32, 37–39, 65.14, 67, DIG. 2; 52/109; 119/416, 436, 437, 444, 502–508, 512–524; 160/136, 138, 152, 159
See application file for complete search history.

(56) References Cited

U.S. PATENT DOCUMENTS

| | | | | |
|---|---|---|---|---|
| 2,711,037 | A | 6/1955 | Tallman | |
| 4,922,655 | A | 5/1990 | Seal | |
| 5,630,572 | A * | 5/1997 | Guay | 256/1 |
| 5,738,341 | A | 4/1998 | Lease | |
| 6,595,496 | B1 | 7/2003 | Langlie et al. | |
| 7,350,480 | B1 | 4/2008 | Hughes | |
| 2001/0015426 | A1 | 8/2001 | Bellon | |
| 2004/0088923 | A1 | 5/2004 | Burke | |
| 2005/0041363 | A1 | 2/2005 | Reid | |
| 2008/0210918 | A1 | 9/2008 | Gilmour | |

* cited by examiner

*Primary Examiner* — Michael P Ferguson
*Assistant Examiner* — Eric Chau
(74) *Attorney, Agent, or Firm* — Coats & Bennett, P.L.L.C.

(57) ABSTRACT

An electrified retaining structure is provided for protecting at least a portion of a designated area. The retaining structure comprises a series of spaced apart scissor lift assemblies. Each scissor lift assembly being moveable up and down between an extended position and a retracted position. In addition, the scissor lift assembly includes one or more sets of elongated rods secured to the scissor lift assembly and extending outwardly therefrom. In the extended position, the rods project outwardly from the lift assembly and form a barrier or retaining structure. An electrical power unit is operatively connected to the rods for providing an electrical current to the rods.

12 Claims, 12 Drawing Sheets

SCISSOR LIFT ASSEMBLY WITH ELECTRIFIED RODS FOR FORMING A RETAINING OR BARRIER STRUCTURE

CROSS-REFERENCE TO RELATED APPLICATION

The present application is a continuation-in-part of U.S. patent application Ser. No. 12/180,918 filed Jul. 28, 2008, the disclosure of which is hereby expressly incorporated by reference.

FIELD OF THE INVENTION

The present invention relates to electric fences, more particularly to a retractable electric fence that can be moved between extended and retracted positions.

BACKGROUND

Homeowners throughout the United States and the world are experiencing increased problems with the deer population. As wooded and forest areas are consumed by residential and commercial development, deer are displaced from their natural habitat and have to seek food in unnatural areas. Often this leads to the yards of homeowners where the deer eat plant materials such as azaleas and the like. In some residential areas the population of deer is so great that homeowners have all but conceded to the deer and have reconciled themselves to the fact that they can no longer have a beautifully landscaped yard.

It is true that many homeowners have attempted to remedy the situation in various ways. For example, there are forms of deer repellant that are used to spray on flowers, shrubs and the like. However, such deer repellant is not effective in many cases and besides, over a period of time the repellant is washed from the vegetation and must be reapplied. Other homeowners have erected electric fences and mesh fences around their homes. These fences are unsightly and electric fences are not friendly to children, dogs and cats. However electric fences themselves when properly erected are an effective measure for preventing deer from eating plant material inside an area enclosed by the fence.

SUMMARY OF THE INVENTION

The present invention relates to a retaining system for protecting a designated area, such as a residential landscaped area. The system includes one or more scissor lift assemblies that are moveable between an extended and a retracted position. There is provided one or more sets of electrified rods secured to each scissor lift assembly. In an extended position, the electrified rods project from one or more sides or areas of the scissor lift assembly. To form a retaining structure, a series of scissor lift assemblies are spaced around at least a portion of the designated area. The scissor lift assemblies are spaced such that the sets of electrified rods extending from the scissor life assemblies form a retaining structure. That is, one set of electrified rods terminate adjacent another set of electrified rods such that the sets of electrified rods form a barrier around the designated area to be protected and in the case of a landscaping area will generally prevent deer and other animals from reaching the designated area and damaging landscaping.

Other objects and advantages of the present invention will become apparent and obvious from a study of the following description and the accompanying drawings which are merely illustrative of such invention.

DESCRIPTION OF EXEMPLARY EMBODIMENTS

The present invention relates to a retractable electric fence 10 for at least partially enclosing an area. In one mode of operation, the electric fence 10 including a series of posts and interconnecting wire extend upwardly from the ground and form a fence or retaining structure. In a second mode, the electric fence 10 including the various posts and connecting wires are retracted such that the posts and the interconnecting wires lie closely adjacent to the ground. This enables a homeowner, for example, to deploy the electric fence at selected times and to retract the electric fence at other times so as to effectively remove the fence as an obstruction. If there are aesthetic concerns about the appearance of the fence when erected, then those aesthetic concerns are addressed when the fence is collapsed or retracted because in a retracted mode the electric fence is substantially hidden and out of view.

Figure 1:
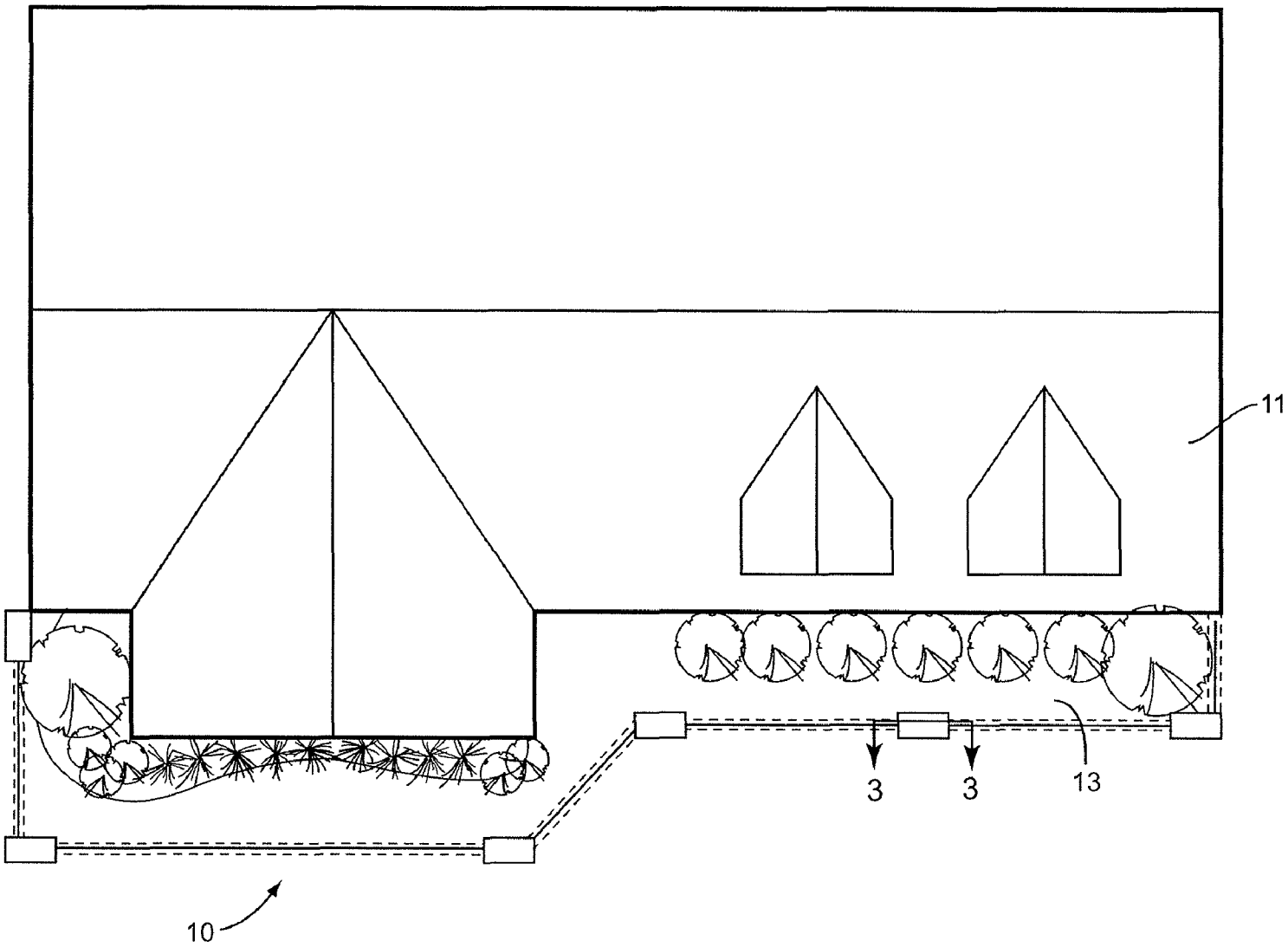
FIG. 1 is a top plan view of a house having a retractable electric fence enclosing an area adjacent to the house.

Turning to the drawings, in FIG. 1 there is shown a residential structure 11 having an electric fence indicated generally by the numeral 10 extending around a fenced area 13 that lies between the front of the house 11 and the electric fence. Electric fence 10 comprises a series of collapsible posts, each post being generally indicated by the numeral 12. Interconnected between the collapsible post 12 are a series of electrically conducted wires 14. The number of wires can vary. Also provided is a series of post housings 16. Each post housing 16 is designed to receive and support one collapsible post. As will be discussed subsequently herein, when the post 12 assumes the collapsed configuration, the associated post housing 16 in corporation with the top of the post will enclose and protect the collapsed post. In addition, extending between the respective housings 16 is a wire receptor indicated generally by the numeral 18. Functionally the wire receptor 18 receives and holds the wires 14 of the electric fence when the electric fence assumes the retracted position. In one embodiment, the post housing 16 and wire receptors 18 are disposed at least partially in the ground such that when the electric fence 10 assumes the retracted position a substantial portion of the electric fence does not extend substantially above ground level.

Electric fence 10 is also provided with a power unit 20. Power unit 20 includes an energizer for electrically charging the wires 14 and a power supply that provides power for actuating and moving each collapsible post 12. As shown in the drawings, wires 21 supply power to the power unit 20.

Figure 2:
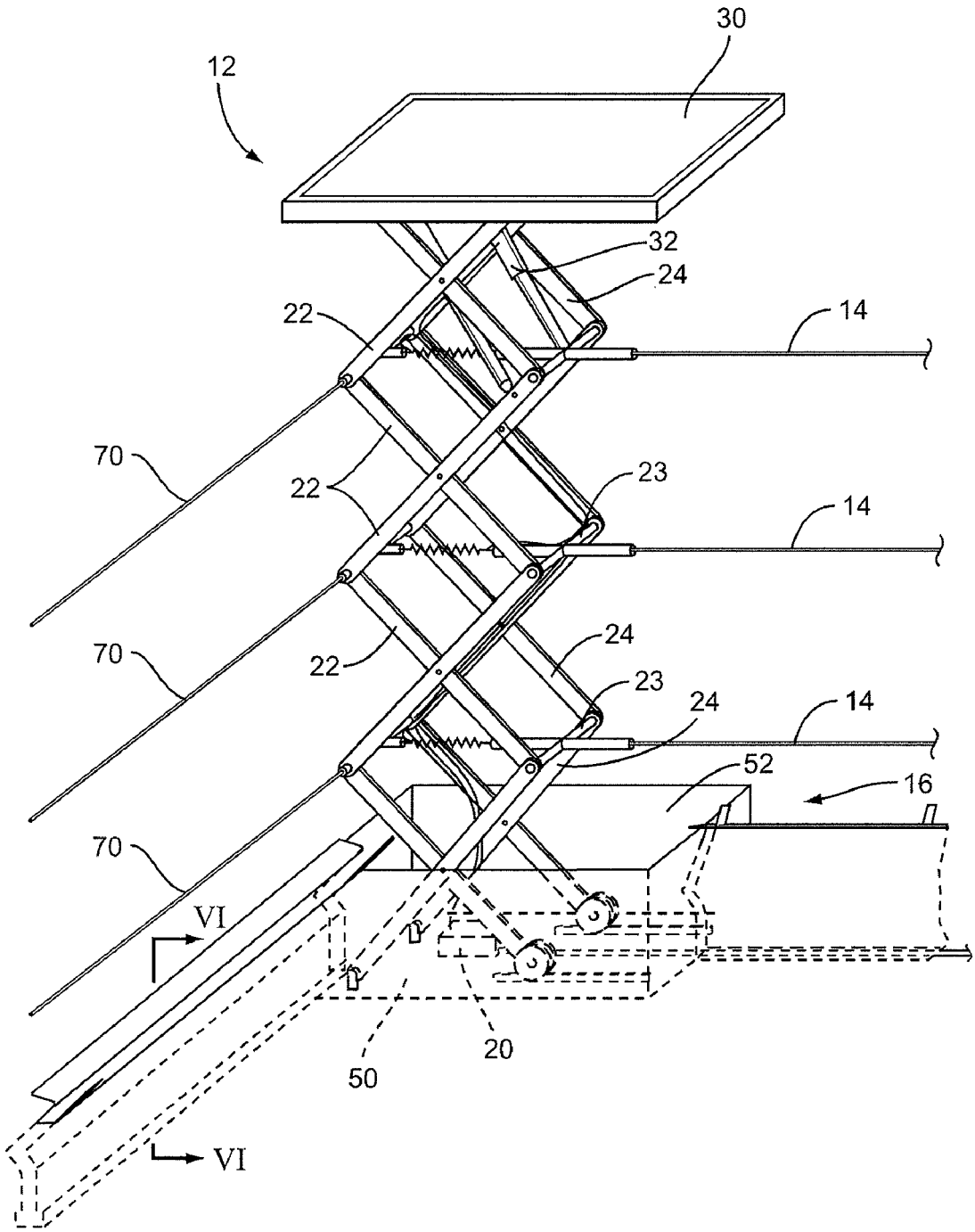
FIG. 2 is a fragmentary perspective view of the electrical fence showing a retractable post utilized at a corner.
Figure 3:
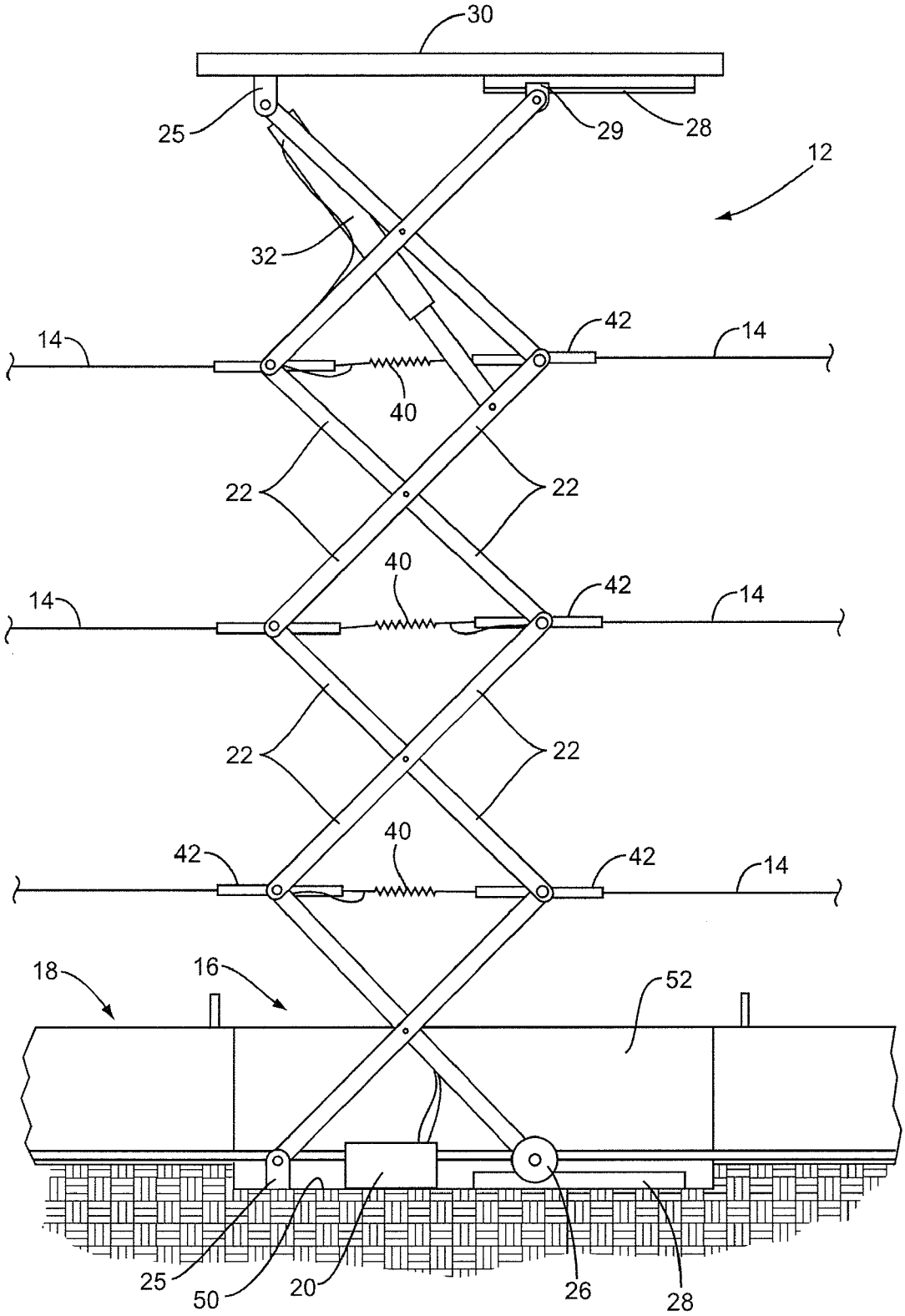
FIG. 3 is a side elevational view of the retractable post illustrating how the post supports a series of wires.
Figure 4:
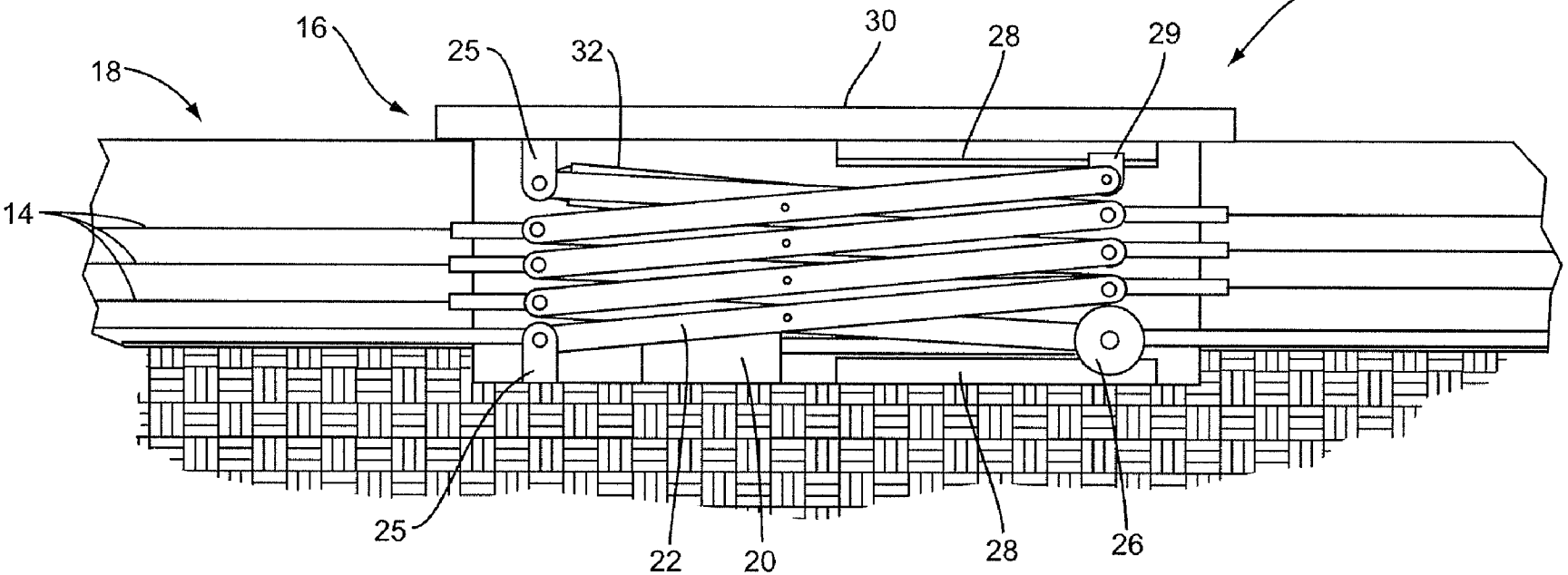
FIG. 4 is a sectional view showing the post in a retracted or collapsed position.
Figure 5:
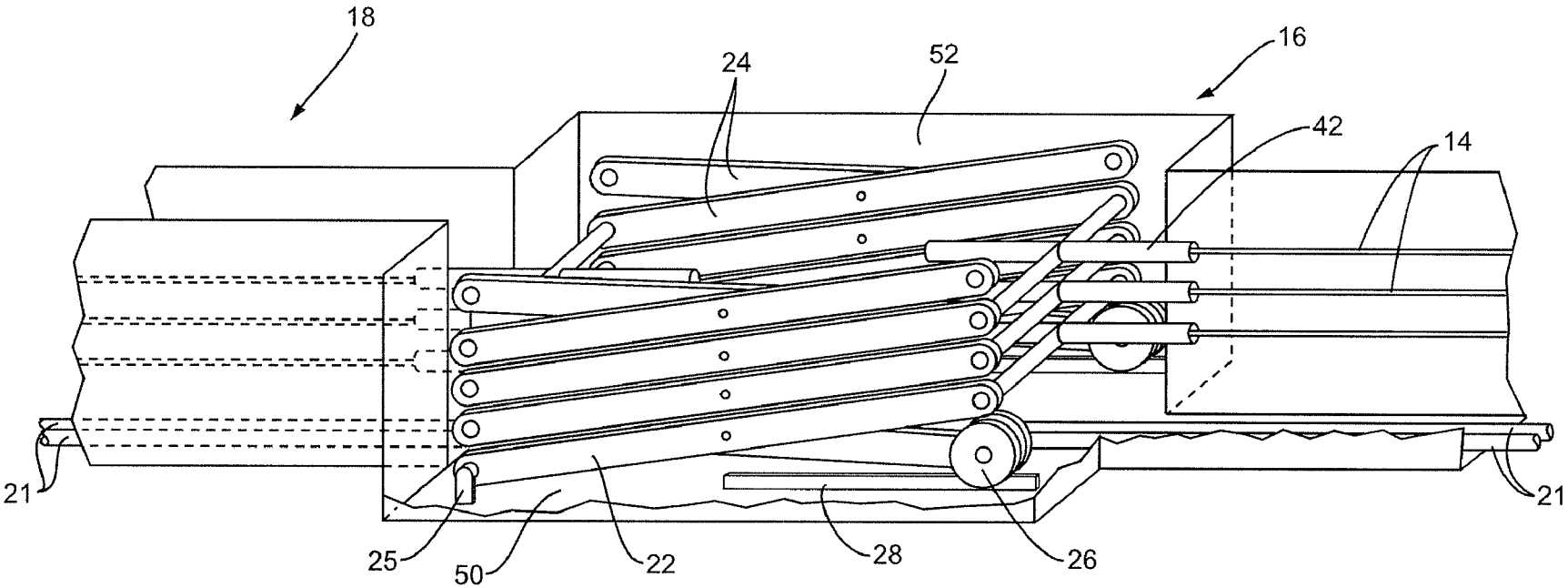
FIG. 5 is a fragmentary perspective view showing a portion of the post in a collapsed position and contained within a housing.

As noted above, electric fence 10 includes a series of collapsible posts 12. Note in FIGS. 2 and 3 where one collapsible post is shown in an extended or elevated position. FIGS. 4 and 5 show the same collapsible post 12 in a retracted or collapsed position. In the embodiment illustrated herein, in order to enable the collapsible post 12 to move between extended and retracted positions, each collapsible post is made up of a scissor linkage. The scissor linkage comprising the collapsible post 12 is shown in FIGS. 2 and 3. Forming the scissor linkage is two sets of linkages, one set on each side of post 12. The first set of linkages includes a series of links 22 that are pivotally connected end-to-end and also are pivotally connected at generally midpoints of the links. On the other side of the post 12 the second set of linkages includes a series of links 24 which are again connected end-to-end and about general midpoints. Extending between the first and second sets of linkages is a series of cross links 23. As viewed in FIG. 3, the sets of linkages are pivotally connected at the bottom and at the top and further includes wheels or slides that enable portions of the linkages to move with respect to each other in conventional fashion. More particular, as viewed in FIG. 3, one of the lower links on each side of the post is pivotally connected to a support 25. The other lower link on each side of the post 12 includes a rotating wheel 26 that moves back and forth on a guide or rail 28. Post 12 and the scissor linkage comprising the same includes a top 30 and the upper links on each side are connected to the top in similar fashion. Again as shown in FIG. 3, one of the upper links on each side of the post 12 is pivotally connected to a support 25 depending from the top 30. The other top links include a slide or wheel 29 that moves back and forth on a guide rail 28. As appreciated by those skilled in the art, this basic scissor linkage allows the post 12 to move up and down between the retracted and extended positions.

To power and move each post 12 between the extended and retracted positions, each post is provided with an electric actuator 32. Details of the electric actuator 32 are not dealt with herein because such is not per se material to the present invention and further electric actuators are well known and appreciated by those skilled in the art. In the case of the embodiment shown herein, the electric actuator 32 is disposed in the upper portion of the scissor linkage and itself is movable between retracted and extended positions. In the extended position the electric actuator is operative to extend the collapsible post 12 to the extended position shown in FIGS. 2 and 3. When electric actuator 32 is retracted, the post 12 will assume a retracted position such as shown in FIG. 4.

A series of electrically conducted wires 14 are secured to selected posts 12 and extend therefrom. As seen in FIGS. 8A-8D, each wire extends from a wire guide 42 that is secured to and projects from a respective cross link 23 found in the scissor linkage. In the exemplary embodiment disclosed herein, the wires 14 projecting from opposite ends or sides of a post 12 are interconnected by a conductive spring 40. See FIG. 3. Each conductive spring 40 serves two functions. First the spring 40 electrically connects the two wire segments 14 that are horizontally aligned and project out from the post. Secondly, the spring 40 biases the post 12 towards a collapsed or retracted position. However the actuator 32 acts against the biasing forces of the springs 40 to maintain the post in an erect or extended position. In some cases, it is contemplated that the wires 14 and the spring 40 can be constructed of the same material or metal. However, in other cases, the spring 40 may be constructed of a heavier gauge material and secured or fastened to respective ends of two wire segments 14.

Various ways exist for energizing the respective wires 14. In one embodiment, power to the wires 14 is provided through wires that extend from the power unit 20 upwardly through the scissor linkage and viewed in FIG. 3. At various points the wires, as shown in FIGS. 8A-8D are connected at a point inside the scissor linkage to a portion of the spring 40. Since spring 40 is operably connected to two adjacent wire segments 14, it follows that the wire segments 14 are energized. Those skilled in the art will appreciate that there are other ways for providing electricity to the wires 14.

Wire guides 42 are shown in FIGS. 8A-8D. While wire guides 42 can be constructed of various materials, it is contemplated they are constructed of dielectric materials and effectively form an insulator.

It is appreciated that the electric fence 10 may need to turn at various points at various angles. Wire guides 42 shown in FIGS. 8A-8D can be utilized to direct the wires 14 from the post 12 such as angles of 30 degrees, 45 degrees, 60 degrees and 90 degrees.

As noted above, each post 12 is provided with a separate housing 16. Housing 16 can be constructed of various materials including plastic, metal and other suitable materials. Housing 16 includes a bottom 50 and a surrounding sidewall structure 52 and an open top. Generally, in one embodiment, it is contemplated that the various housings 16 are at least partially disposed in the ground. In some cases the open top of the housing 16 is at ground level or perhaps just above ground level so as to prevent water and debris from seeping into the top of the housing. As seen in FIG. 4, when the post 12 assumes the retracted position, the top 30 of the post 12 fits over the open top of the housing 16 so as to effectively close the housing and generally protect the scissor linkage that makes up the post 12.

Figure 6:
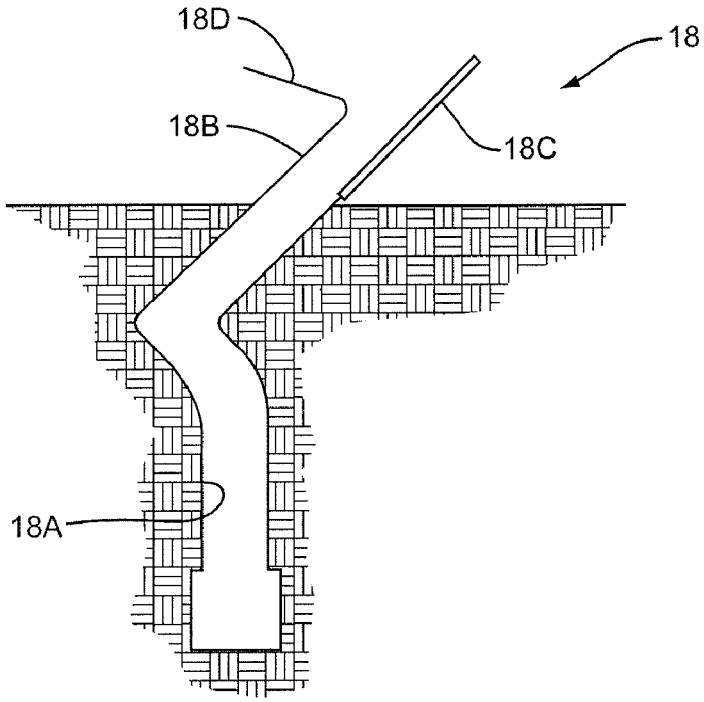
FIG. 6 is a cross sectional view of the wire receptor partially disposed within the ground.
Figure 7:
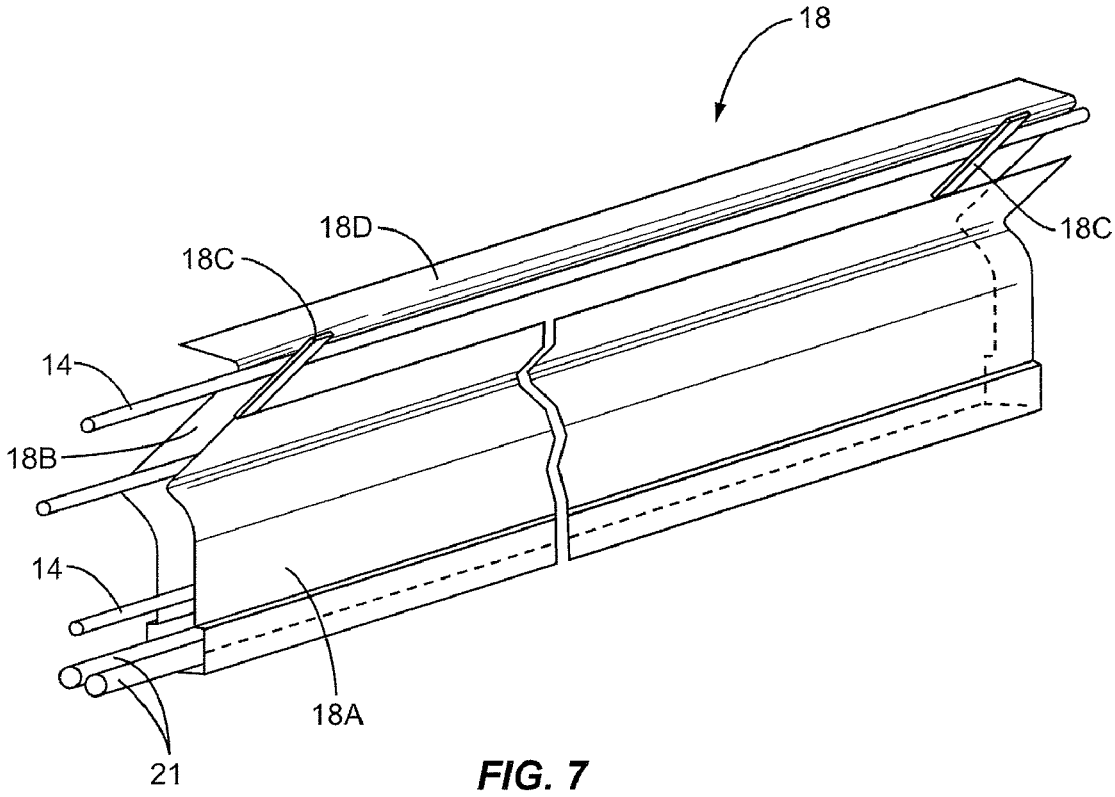
FIG. 7 is a fragmentary perspective view showing the wire receptor with a series of wires extending through the same.
Figure 8A:
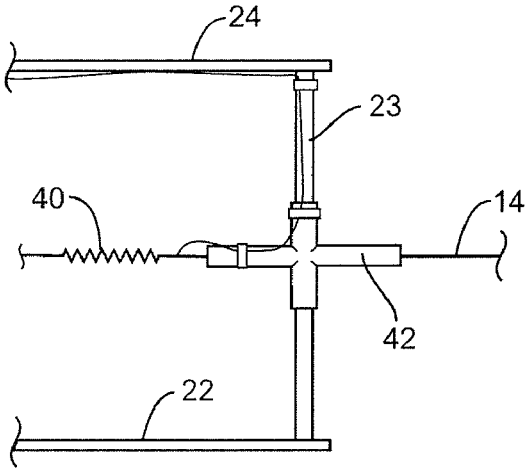
FIG. 8A shows a portion of an extendable post and how a conductive wire attaches to the same.
Figure 8B:
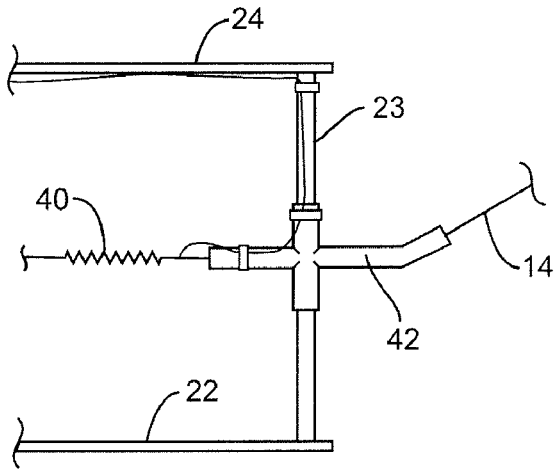
FIG. 8B is similar to FIG. 8A but shows a wire connector that permits the wire to extend at an angle from the post.
Figure 8C:
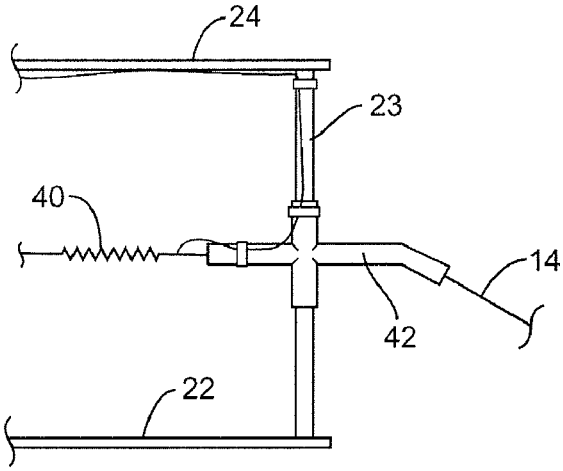
FIG. 8C is a view similar to FIG. 8B but showing the wire connector permitting the wire to extend at an angle in the opposite direction from that shown in FIG. 8B.
Figure 8D:
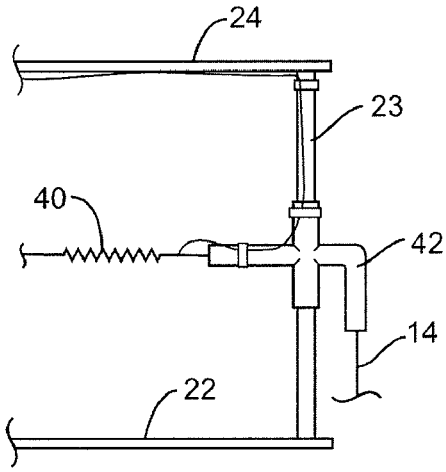
FIG. 8D is a view similar to FIGS. 8A-8C but showing the wire extending at an angle of approximately 90 degrees with respect to the post.

In addition to the housing, there is provided a number of wire receptors 18 that are connected between the housings 16 to receive and hold wires 14 when the electric fence is in the retracted position. FIGS. 6 and 7 show a portion of a wire receptor 18. The wire receptor forms a trough and is generally disposed at least partially in the ground. Wire receptor 18 includes an open angled top (FIG. 6). Wire receptor 18 like housing 16 can be constructed of various materials such as plastic, metal, etc. As illustrated in FIG. 6, the wire receptor 18 includes a bottom portion 18A and a top portion 18B. About the top portion, there is provided a series of spaced upstanding fingers or guides 18C that assist in guiding the wires 14 into the wire receptor 18 as the posts 12 are lowered to the collapsed or retract position. Disposed on the other side of the wire receptor 18 is a flanged 18D that projects outwardly from one side of the wire receptor.

In some locations, it may be impractical to extend wires 14 from a respective post 12. Still it may be important to provide a fence or obstacle in this area. FIG. 2 shows a series of cantilevered metal rods 70 that project from the post 12. For example, if the post 12 shown in FIG. 2 is disposed in close proximity to the corner of a residential structure, the cantilever metal rod 70 can be projected from the post to the corner of the residential structure or to some other static structure. In one embodiment, the cantilevered metal rods 70 can be electrically energized in the same manner as the wires 14.

Various controls can be employed to actuate the electric fence 10 and to move the electric fence back and forth between extended and retracted positions. In one embodiment, a timer can be utilized to deploy or extend the fence during a certain time of each day, for example, between sunset and sunrise. In other cases, a motion detector can be utilized. When motion is detected in the vicinity of the area that is desired to be protected, then the actuators 32 can be activated causing the electric fence 10 to be deployed. Also, there can be provided a device for sounding an alarm or emitting a signal just prior to the fence being deployed.

From the foregoing discussion it is appreciated that the electric fence 10 of the present invention enables a homeowner to protect gardens, shrubbery and the general landscape around a residential structure. The electric fence system disclosed herein has the advantage of providing a proven barrier that will prevent deer from eating and destroying plant material and at the same time the electric fence system enables one to automatically remove its presence during selected periods of time thereby avoiding the unsightly appearance of an electric fence in the yard of a homeowner. In addition to its application for residential homeowners, the electric fence system of the present invention can also be utilized in similar ways in commercial or industrial settings. Also, when the electric fence is deployed, it provides some measure of security around a building inasmuch as it acts as a deterrent to intruders.

As discussed above, there are various ways for powering the respective wires 14 and the electric actuators 32. In some cases, the wires 14 and electric actuators 32 are powered by the same source. In other cases, they are powered independently. More particularly, in one embodiment, the power unit 20 would essentially be a central control unit having a battery and a power supply, timer, sensor input and optionally a solar panel for recharging the battery. In this case, the wires 21 would serve as a power bus to energize both the wires 14 and the actuators 32. Another option is to provide independent controllers for powering the actuators 32 and wires 14 independently.

In addition, as an option, the wire receptors 18 can be provided with one or more heating elements to melt snow or ice in the winter to keep the fence operational. This can be accomplished by utilizing a current driver or power source applied to the wires 14 or one or more separate heating elements located in the bottom of the wire receptors 18 and operatively connected to the control unit 20.

With reference to FIGS. 9-13, another embodiment of the present invention is shown therein. In this embodiment, there is provided a scissor life assembly which is indicated generally by the numeral 12. In the prior embodiments, this basic lifting structure was referred to as a post. However, in this embodiment, it is more properly referred to as a lift assembly.

Figure 9:
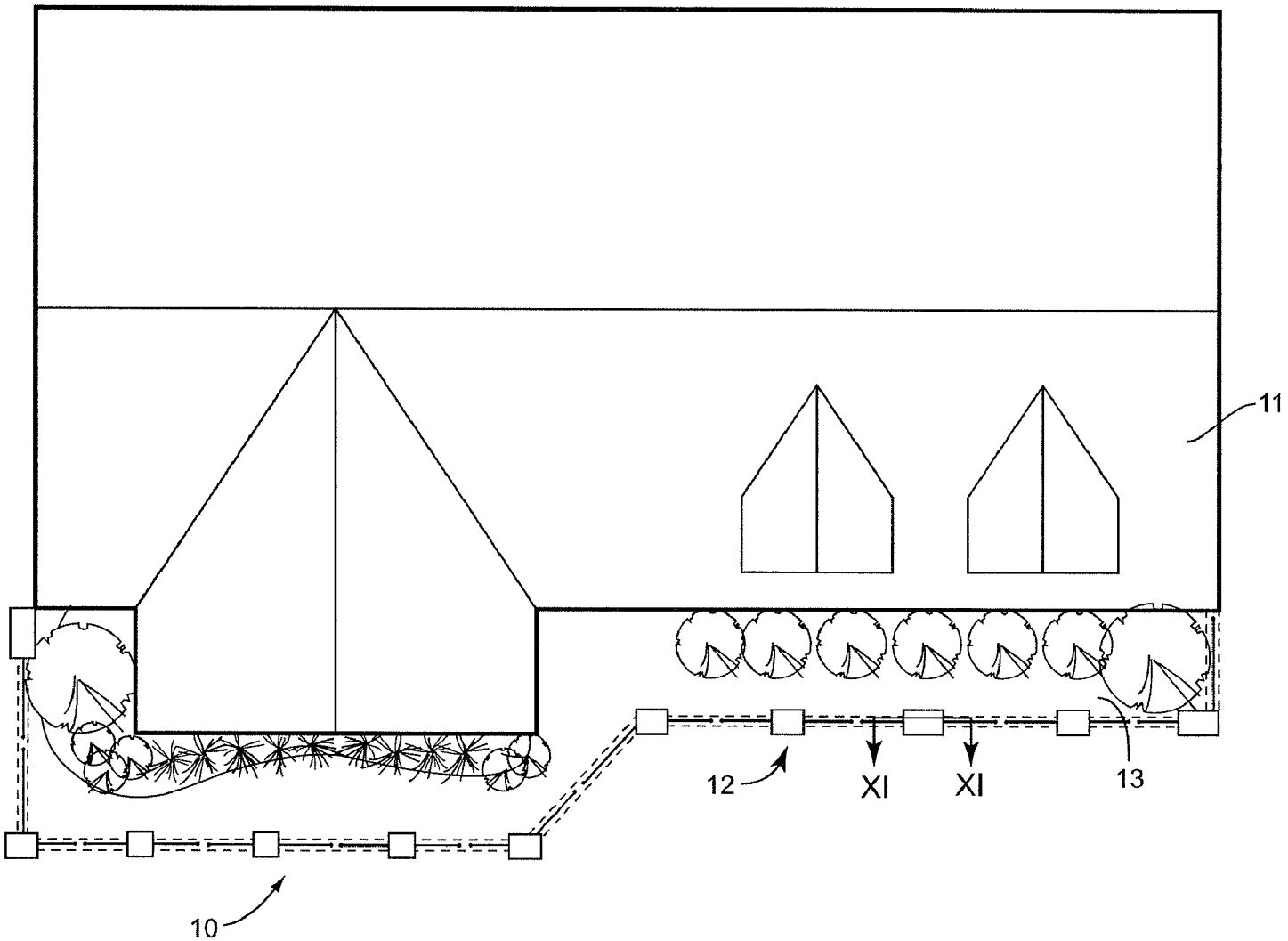
FIG. 9 is a plan view showing a second embodiment of the present invention comprising a series of scissor lift assemblies having electrified rods for forming a barrier.

As shown in FIG. 9, a retaining structure extends around a front yard area of a residential structure. This retaining structure includes a series of spaced apart scissor lift assemblies 12. As will be discussed more fully below, each scissor lift assembly 12 includes at least one set of electrified rods that are supported in cantilever fashion from the scissor lift assembly. That is the cantilevered rods project outwardly from a side or other portion of the scissor lift assembly 12. In the case of the embodiment illustrated in FIG. 9, there is provided a multitude of scissor lift assemblies 12. They are spaced apart such that the respective sets of rods extending therefrom will form a generally continuous barrier between the respective lift assemblies 12. In this embodiment, the formed barrier is not precisely continuous. This is because the electrified rods, referred to by the numeral 70 in the drawings, have terminal ends 70A. Terminal ends 70A terminate such that there is at least a slight space or some overlapment of the end portions of the electrified rods 70 such that there is inadequate space for animals such as a deer to pass through the rods without engaging one or more of the electrified rods.

Figure 11:
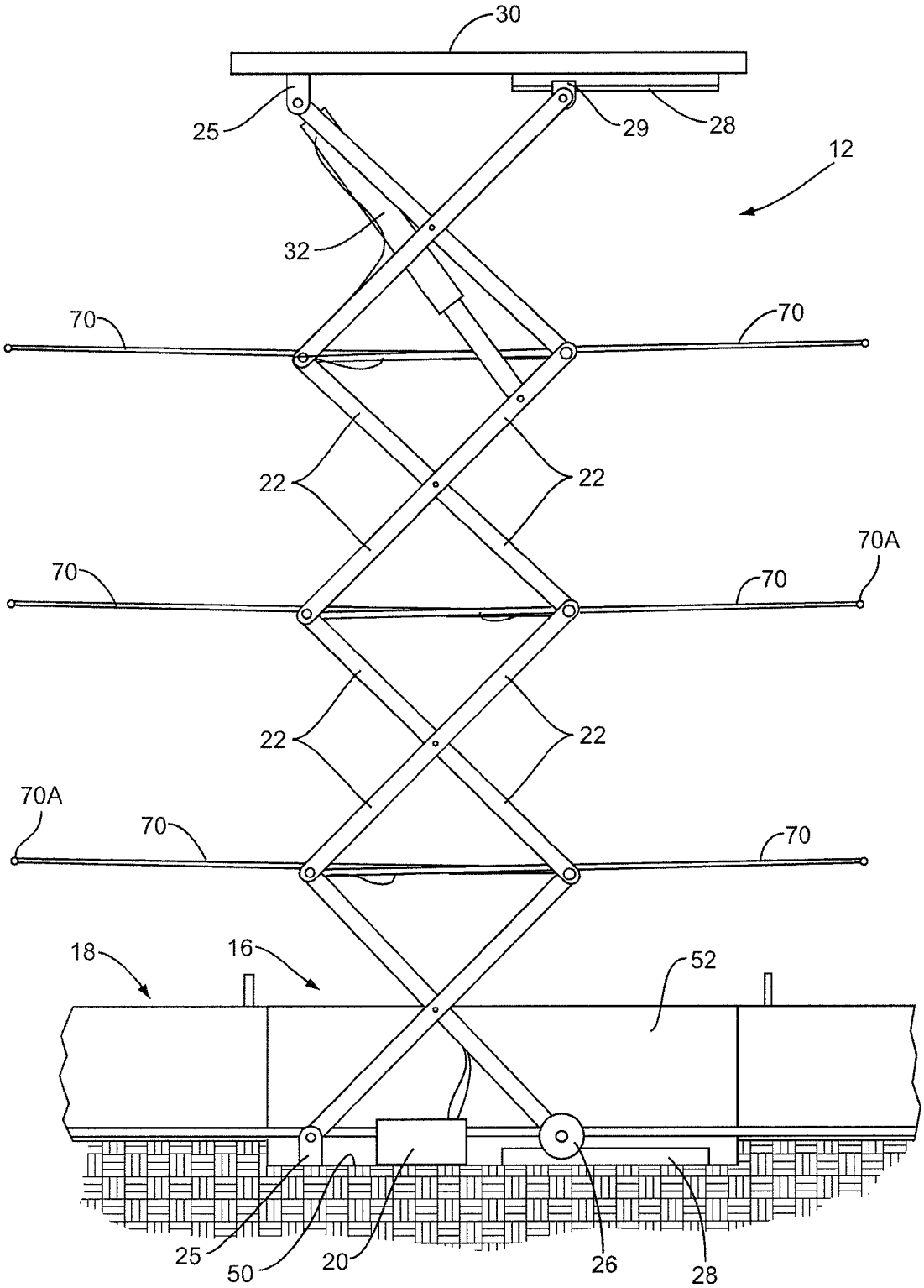
FIG. 11 is a side elevational view of the scissor life assembly showing two sets of electrified rods projecting from opposite sides of the assembly.

Turning to FIG. 11, there is shown therein a scissor lift assembly 12. It is provided with two sets of electrified rods 70, one set projecting from the left side and one set projecting from the right side. Note that each rod 70 includes a terminal end 70A. The effective length of the rod 70 can vary. When the scissor lift assembly 12 is in the extended position, shown in FIG. 11, the rods 70 have a substantial reach. That is, they could extend for example four to eight feet from the scissor lift assembly itself. The rods 70 are typically metal rods which facilitate being able to carry a current and effectively be electrified.

As seen in the drawings, each rod 70 is supported in cantilever fashion from the scissor lift assembly 12. Each rod includes a secured end that is secured to a respective crosslink 23 of the scissor linkage. From that securement point, each electrified rod 70 extends through the scissor linkage and through a guide sleeve 80 disposed on the opposed crosslink 23. Thus it is seen that in the case of the embodiment shown in FIG. 11 there is effectively two rods 70 projecting through the scissor linkage at vertical intervals in the scissor lift assembly 12.

Figure 10:
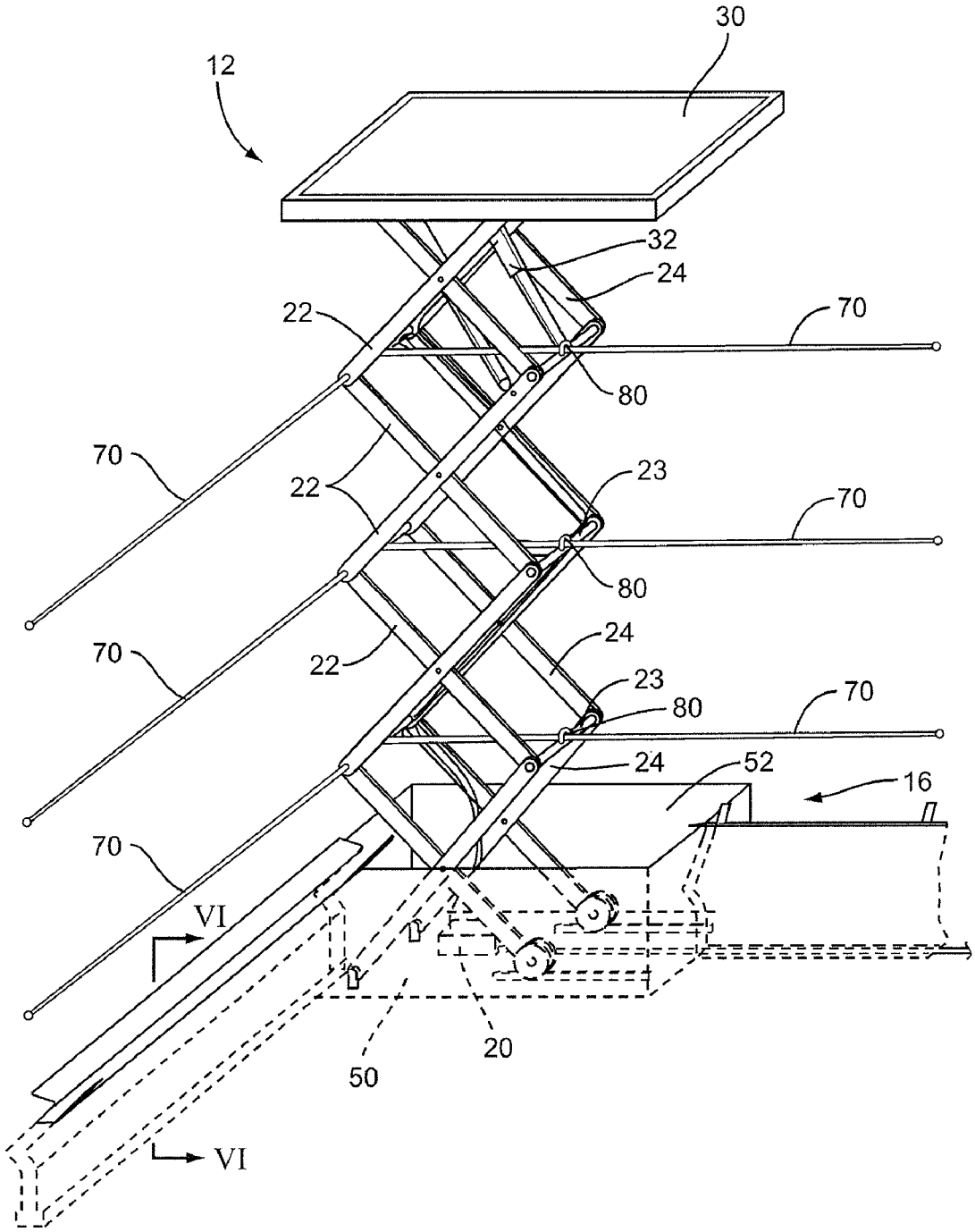
FIG. 10 is a perspective view of the scissor lift assembly having two sets of electrified rods projecting therefrom at an angle.
Figure 12:
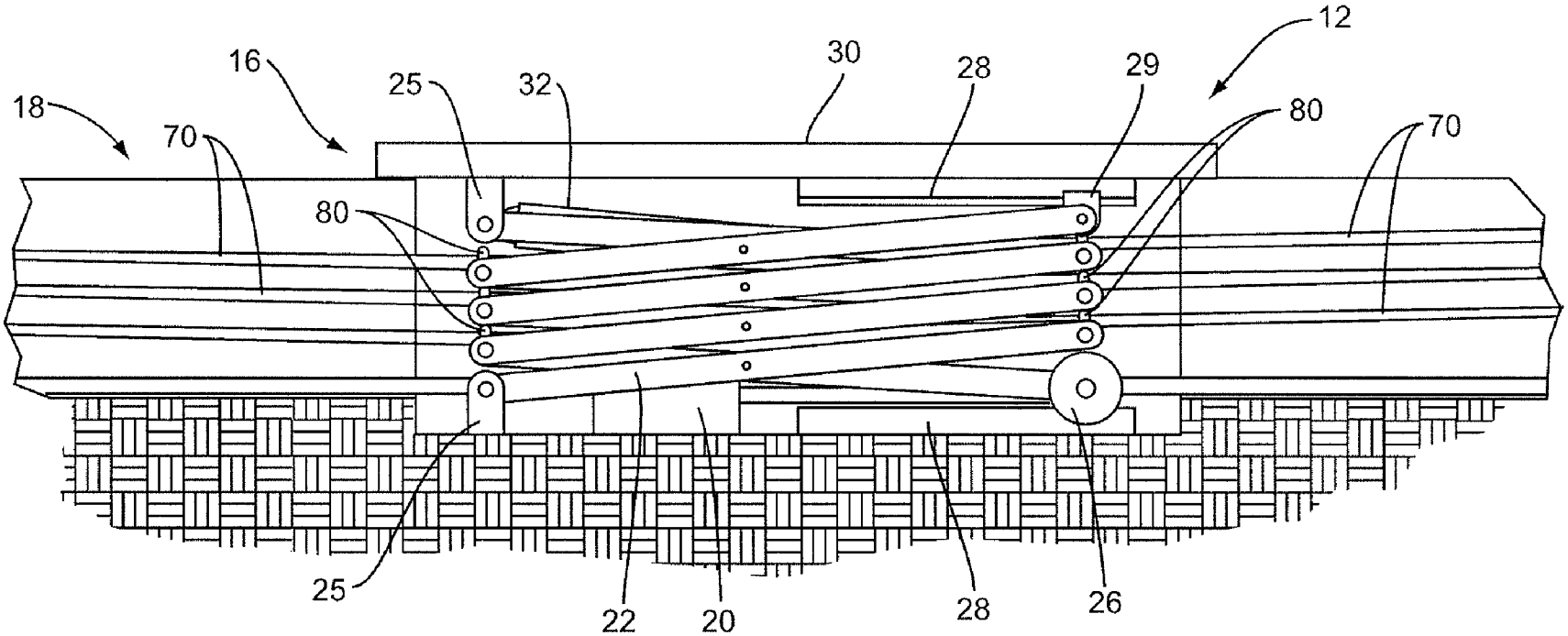
FIG. 12 is a sectional view showing the scissor lift assembly disposed in the retracted position and housed within a housing.
Figure 13:
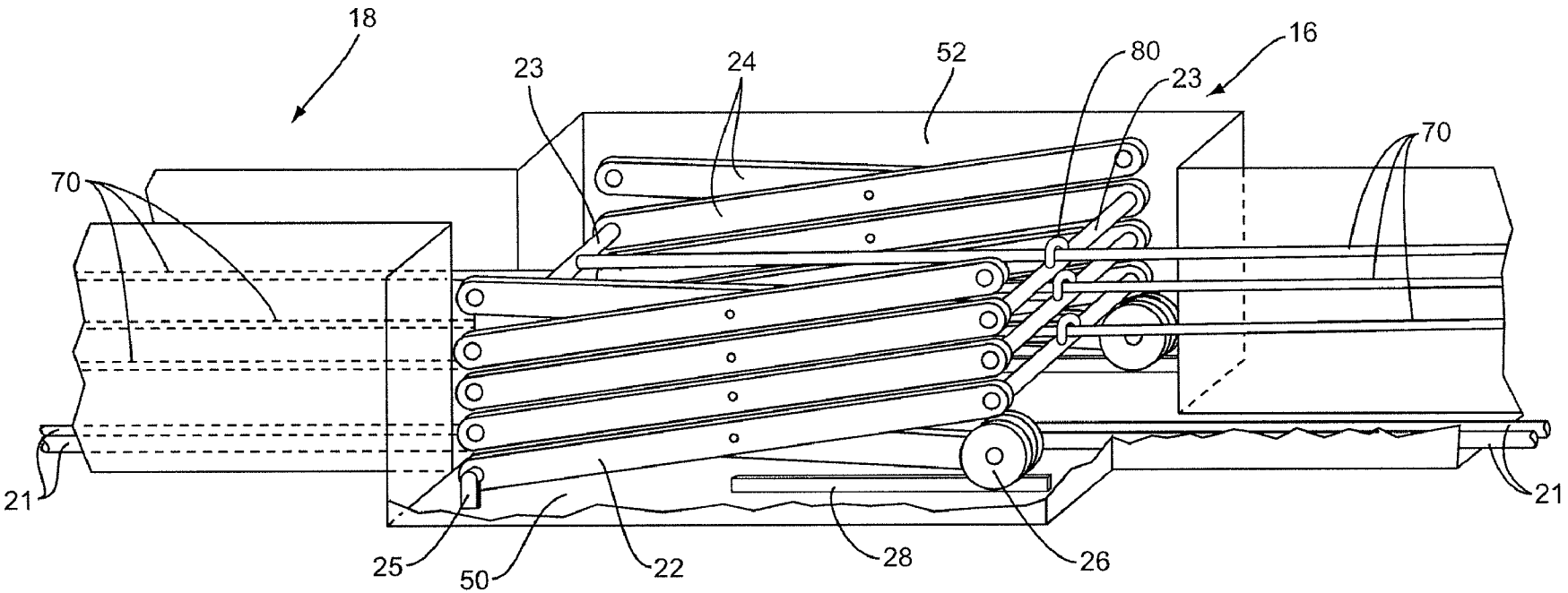
FIG. 13 is a fragmentary perspective view showing portions of the scissor lift assembly in the retracted position and disposed within the housing.

The scissor lift assembly 12 shown in FIGS. 10 and 11 is moveable from an extended position shown in FIGS. 10 and 11 to a retracted position shown in FIG. 12. Because of the nature of the scissor linkage, the vertical spacing between the rods 70 and the degree of extension of the rods 70 outwardly from the lift assembly varies as the lift assembly moves between the extended and retracted position. For example, in FIG. 11, the scissor lift assembly 12 is in the extended position and in this position, the electrified rods extend a maximum length outwardly relative to the scissor linkage. Further, as the scissor lift assembly moves from the extended position to the retracted position, the vertical spacing between the respective rods 70 decreases. Note in FIG. 11, when the scissor lift assembly 12 is in the extended position, the vertical spacing between the respective electrified rods is a maximum. As the scissor lift assembly 12 retracts towards the position shown in FIG. 12, this spacing decreases. In the retracted position, the rods 70 will be closely spaced apart or may actually engage each other. Also as eluded to before, as the lift assembly 12 extends, the electrified rods project outwardly from the lift assembly. That is, as the scissor lift assembly 12 moves towards the extended position, more length of each electrified rod 70 lies outside the confines of the scissor linkage.

In the embodiment illustrated in FIG. 11, the first and second sets of electrified rods are generally aligned or parallel. In the case of the embodiment shown in FIG. 10, there is also first and second sets of electrified rods 70 supported in cantilever fashion but these sets of rods are not aligned or parallel. They are disposed at an angle. Thus in the case of the embodiment shown in FIG. 10, the scissor lift assembly 12 is utilized to form a corner in a retaining structure or at least form a part of a retaining structure where the respective sets of electrified rods 70 are not aligned or parallel with respect to a single scissor lift assembly 12. In the FIG. 10 embodiment, one set of electrified rods, the set on the right, is secured to the linkage assembly in the same manner as discussed and shown in FIG. 11. However, the second set of electrified rods 70 disposed on the left as viewed in FIG. 10 is simply secured to a portion of the front or back side of the scissor linkage. It should be appreciated that the electrified rods 70 can be secured to the scissor linkage in various ways and at various orientations. The concept here is to provide a generally continuous retaining structure where the electrified rods 70 and scissor lift assembly are utilized in conjunction with other scissor lift assemblies having electrified rods to form a generally continuous retaining structure as shown in FIG. 9.

Each scissor lift assembly 12 of the present invention is designed to be supported within the housing 16. The housing 16 includes a bottom 50 and a side wall structure 52. The scissor lift assembly 12 includes a top 30 that is designed to mate with the housing 16 when the scissor lift assembly assumes the retracted position. Note in FIG. 12 where the top 30 effectively closes the top of the housing 16 such that the scissor linkage is contained within the housing and protected from the weather and environment when in the retracted position.

As with the embodiments discussed above, the retaining system of the present invention includes a receptor structure 18 for receiving the elongated and electrified rods 70 when the scissor lift assembly assumes the retracted position. There is provided openings in the side well 52 of the housing 16 to enable the electrified rods 70 to project therefrom into the adjacent receptor structure 18.

As discussed above, the rods 70 are metal and are electrified via a power unit 12. Power unit 12 includes an energizer for electrically charging the rods 70 and a power supply that provides power for actuating and moving the scissor lift assembly between the extended and retracted positions.

Preferably the scissor lift assembly 12 when in the retracted position should not extend substantially into the ground or other underlying support structure. Preferably when in the retracted position, the depth that the scissor lift assembly 12 extends into the ground or other underlying support structure should be less than 25% of the height of the scissor lift assembly when in the fully extended position.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A retractable and extendible electric retaining system for at least partially enclosing an area having plant materials and preventing deer and other animals from eating the plant material, comprising:

a scissor lift assembly moveable up and down between a retracted position and an extended position along a vertical path;

the scissor lift assembly including two parallel collapsible scissor linkages connected transversely by a series of crosslinks, wherein each collapsible scissor linkage comprises a plurality of pairs of links pivotally connected at intermediate points between ends of the link, each link from each pair pivotally connected end-to-end to a link from an adjacent pair of links, wherein the ends of links from one collapsible scissor linkage are connected to corresponding ends of links from the other collapsible scissor linkage by the crosslinks, such that as the scissor lift assembly retracts and extends, the ends of each link pivot about the intermediate points of each link, and the ends of each link and each crosslink moves horizontally away and towards the vertical path;

at least one set of elongated rods, for enclosing the area, the set of rods including a plurality of rods set at a plurality of vertical levels along the scissor lift assembly, wherein each rod is secured at a first end in cantilever fashion to the scissor lift assembly and having a second end projecting horizontally outwardly therefrom, and wherein as the scissor lift assembly moves up to the extended position, the vertical spacing between each rod increases, and wherein as the scissor lift assembly moves down to the retracted position, the vertical spacing between each rod decreases;

a housing structure including a bottom and side walls defining a recess adapted to be supported by the ground and configured to receive and hold the scissor lift assembly when in the retracted position;

a top secured to an upper portion of the scissor lift assembly and which closes the recess when the scissor lift assembly assumes the retracted position such that the housing and top enclose and protect the retracted scissor lift assembly; and an electrical power unit operatively connected to the elongated rods and providing an electrical current to the cantilevered rods.

2. The retractable and extendable electric retaining system of claim 1 wherein there are two sets of cantilevered rods, with each set of rods extending outwardly from opposed sides of the scissor lift assembly.

3. The retractable and extendable electric retaining system of claim 2 wherein the respective rods of each set cross within the scissor linkage.

4. The retractable and extendable electric retaining system of claim 1 wherein there are provided two sets of cantilevered rods projecting from the scissor lift assembly and wherein the two sets of rods are non-aligned and disposed at an angle with respect to each other.

5. The retractable and extendable electric retaining system of claim 1 including a receptor structure positioned in the ground adjacent a scissor lift assembly for receiving and holding the cantilevered rods when the scissor lift assembly assumes the retracted position; the receptor structure including a bottom section and an upper section and wherein the upper section includes an open top and wherein the upper section extends at an angle with respect to the lower section and wherein the upper section is configured to project out of the ground.

6. The retractable and extendable electric retaining system of claim 1 including a series of spaced apart scissor lift assemblies and and wherein first and second scissor lift assemblies are spaced apart such that the horizontally projecting second ends of one set of cantilever rods of a first scissor lift assembly terminate in close proximity to the horizontally projecting second ends of a second set of rods of a second scissor lift assembly such that the first and second sets of cantilevered rods form an electric retaining barrier between the first and second scissor lift assemblies.

7. The retractable and extendable electric retaining system of claim 1 wherein the cantilevered first end of each elongated rod is fixed to one of the crosslinks at a given vertical level, with the second end slidably supported through a guide on another one of the crosslinks at the same given vertical level as the crosslink to which the first end is fixed, wherein as the scissor lift assembly moves up to the extended position, the second ends of each rod extend horizontally away from the scissor lift, and as the scissor lift assembly moves down to the retracted position, the second ends of each rod retracts horizontally toward the scissor lift.

8. The retractable and extendable electric retaining system of claim 1 wherein the scissor lift assembly is disposed in at least a portion of the ground or an underlying support structure and wherein when in the retracted position, the depth that the scissor lift assembly extends into the ground or into the underlying support structure is less than 25% of the height of the scissor lift assembly when in the extended position.

9. An electrified retaining structure disposed around at least a portion of a designated area to protect the area, comprising:

a series of spaced apart scissor lift assemblies surrounding at least a portion of the designated area;

each scissor lift assembly is moveable up and down between a retracted position and an extended position along a vertical path;

each scissor lift assembly including two parallel collapsible scissor linkages connected transversely by a series of crosslinks, wherein each collapsible scissor linkage comprises a plurality of pairs of links pivotally connected at intermediate points between ends of the link, each link from each pair pivotally connected end-to-end to a link from an adjacent pair of links, wherein the ends of links from one collapsible scissor linkage are connected to corresponding ends of links from the other collapsible scissor linkage by the crosslinks, such that as the scissor lift assembly retracts and extends, the ends of each link pivot about the intermediate points of each link, and the ends of each link and each crosslink moves horizontally away and towards the vertical path;

at least one set of elongated rods, for enclosing the area, the set of rods including a plurality of rods set at a plurality of vertical levels along the scissor lift assembly, wherein each rod is secured at a first end in cantilever fashion to the scissor lift assembly and having a second end projecting horizontally outwardly therefrom to form at least a portion of a retaining fence, and wherein as the scissor lift assembly moves up to the extended position, the vertical spacing between each rod increases, and wherein as the scissor lift assembly moves down to the retracted position, the vertical spacing between each rod decreases;

a housing structure including a bottom and side walls defining a recess adapted to be supported by the ground and configured to receive and hold the scissor lift assembly when in the retracted position;

a top secured to an upper portion of the scissor lift assembly and which closes the recess when the scissor lift assembly assumes the retracted position such that the housing and top enclose and protect the retracted scissor lift assembly;

an electrical power unit operatively connected to the elongated rods and providing an electrical current to the cantilevered rods;

wherein the scissor lift assemblies are spaced around a portion of the designated area such that between a respective pair of consecutive scissor lift assemblies there extends two sets of cantilevered rods, one set of cantilevered rods extending from each of the pair of scissor lift assemblies; and wherein the two sets of cantilevered rods extending between the consecutive scissor lift assemblies include terminal ends that terminate in close proximity to each other so as to form a retaining barrier between the consecutive scissor lift assemblies.

10. The electrified retaining structure of claim 9 wherein each scissor lift assembly includes two sets of cantilevered metal rods with each set of cantilevered rods projecting outwardly from opposed sides of the scissor lift assembly.

11. The electrified retaining structure of claim 9 wherein there are provided a plurality of receptors with each receptor being associated with one scissor lift assembly; each receptor adapted to be positioned in the ground adjacent a respective scissor lift assembly and configured to receive and hold the cantilevered rods extending from the associated scissor lift assembly when the scissor lift assembly assumes the retracted position; the receptor including a bottom section and an upper section and wherein the upper section includes an open top and wherein the upper section extends at an angle with respect to the lower section and wherein the upper section is configured to project out of the ground.

12. The retractable and extendible electric retaining system of claim 9 wherein at least one of the scissor lift assemblies includes two sets of cantilevered rods projecting from the scissor lift assembly where the two sets of rods are non-aligned and disposed at an angle with respect to each other.

* * * * *